United States Patent [19]

Very

[11] Patent Number: 4,746,014

[45] Date of Patent: May 24, 1988

[54] GOLF CLUB PROTECTIVE DEVICE

[76] Inventor: Roland A. Very, 122 Lake Placid Close, SE., Calgary, Alberta, Canada, T2J 5A5

[21] Appl. No.: 86,878

[22] Filed: Aug. 19, 1987

[30] Foreign Application Priority Data

Aug. 20, 1986 [CA] Canada ..... 516357

[51] Int. Cl.[4] ..... A63B 55/00

[52] U.S. Cl. ..... 206/315.6

[58] Field of Search ..... 206/315.2, 315.3, 315.6

[56] References Cited

U.S. PATENT DOCUMENTS 4,029,136 6/1977 Jacoby ..... 206/315.3 X 4,200,131 4/1980 Chitwood et al. ..... 206/315.6

*Primary Examiner*—William Price

*Attorney, Agent, or Firm*—Stoll, Wilkie, Previto & Hoffman

[57] ABSTRACT

A tubular protective device for storing golf clubs in golf bags which is adapted to rise above the level of the other tubes in the bag when a golf club is removed from the tube thereby permitting the user to readily locate the tube to which the golf club is to be returned. The device consists of an elongated tube to which is attached a spring which has a resilient restoration force which is less than the combined weight of the tube and the golf club and is greater than the weight of the tube alone.

18 Claims, 1 Drawing Sheet

GOLF CLUB PROTECTIVE DEVICE

BRIEF BACKGROUND OF INVENTION

This invention relates to protective tubes for storing golf clubs in golf bags, and in particular to a protective tube the tops of which rises above the level of the heads of the golf clubs remaining in the bag when the tube is empty and returns to a position level with the tops of the remaining tubes in the bag when a club is stored in the tube.

Protector tubes for storing clubs in golf bags have been known and used for a considerable period of time. Such tubes protect the club shaft and grip and allow the club to be removed and returned to the bag easily and smoothly and without dragging the shafts and grips against one another. However, one disadvantage of the use of tubes for storing golf clubs is that when a club is removed from a bag, the opening of the tube often becomes obscured by movements of the heads of clubs in adjacent tubes. This results in frustration for a golfer wishing to return a club quickly and necessitates movement of club heads until the tube opening is located.

There have been suggestions for devices that elevate a chosen golf club from the remaining clubs in the bag as shown in U.S. Pat. No. 4,029,136 dated June 14, 1977 entitled "Selective Golf Club Dispenser" and U.S. Pat. No. 4,200,131 dated Apr. 29, 1980 entitled "Device for Carrying Golf Clubs".

U.S. Pat. No. 4,200,131 discloses a device consisting of a series of tubes for receiving golf clubs with a compression spring located at the bottom of each tube adapted to contact the end of the golf club shaft. At the top of each tube an overhanging surface is adapted to maintain a golf club in place. As the golf club is returned to the bag it is pressed down against the spring and and positioned under the overhang which then maintains the golf club in place. In order to remove the golf club, the head is depressed and rotated out of contact with the overhang thereby causing the club to move upwardly through the action of the spring. This device requires that the user press the club downwardly against the pressure of the spring and into engagement with the overhang in order to return the club to the bag. Moreover the device does not cause an empty tube to rise above the level of the clubs in the bag thus permitting the golfer to readily locate the tube from which the club was taken.

U.S. Pat. No. 4,029,136 discloses a device comprising a series of tubes which are upwardly biased by compression springs at the bottoms thereof. The device includes a separate latching means for each of the tubes to hold it in its downward position. Upon release of the latching means the tube containing the desired club will move upwardly under the action of the spring. In order to return the club to the bag it is necessary to press the golf club downwardly against the action of the spring and when the tube is returned to its depressed position, to operate the latching mechanism to thereby hold the tube and club in place. In this mechanism the resilient force on the spring is greater than the weight of the tube and club combined with the result that it is necessary to return the club and tube to its normal position by exerting downward pressure against them. This device has the disadvantage of requiring a latching mechanism which results in increased mechanical complexity and weight. Moreover, the tube will not return to its depressed position in the bag under the weight of the club but rather requires a downward force to be applied by the golfer against the club and tube and requires the operation of the latching mechanism once the tube is in its depressed position.

BRIEF SUMMARY OF INVENTION

The present invention provides a mechanism whereby when a club is removed from a tube the tube will rise above the level of the clubs remaining in the bag thereby providing an easily detectable and unobscured opening for the golfer to return the club to the bag. The present invention also provides a means by which when a club is returned to a tube in its elevated position, the tube will return to its lower position without the necessity of the golfer applying pressure and will remain in the depressed position without the necessity of a latching mechanism.

In accordance with the present invention there is provided a protective device for storing a golf club comprising: an elongated tube within which said golf club is adapted to be stored, resilient spring means operatively associated with said tube for biasing the position of said tube, said spring means having a resilient restoration force when deformed which is less than the combined weight of said tube and said golf club and is greater than the weight of said tube.

BRIEF DESCRIPTION OF THE DRAWINGS

In drawings which illustrate embodiments of the invention.

Figure 4:
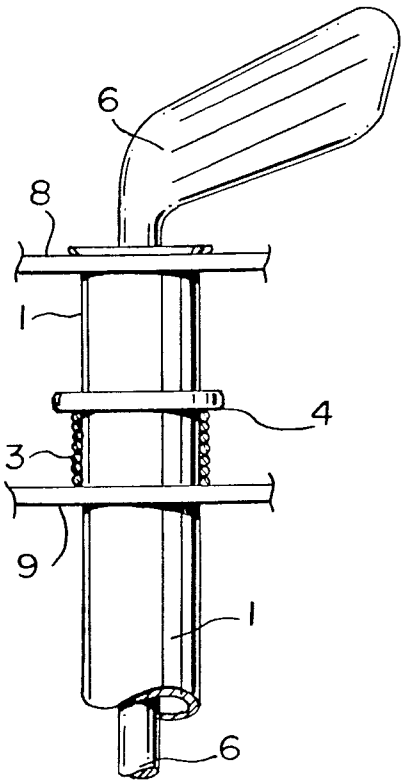
FIG. 4 illustrates the embodiment of FIG. 3 with a golf club positioned therein, wherein the club protective tube is in its depressed position.

In accordance with the present invention there is provided a protective device for a golf club comprising: a first elongated tube within which said golf club is adapted to be stored, a second elongated tube having an inner diameter greater than the outer diameter of said first tube, said first tube being positioned within said second tube in slidable relationship thereto, resilient spring means having first and second ends, said first end of said spring means being operatively associated with said first tube and said second end of said spring means being operatively associated with said second tube, said spring means being adapted to bias said first tube to a position wherein a portion of said first tube is outside said second tube.

In accordance with the present invention there is further provided a protective apparatus for storing golf clubs in a golf bag, comprising: a divider plate having a plurality of circular openings, a plurality of golf club retaining means within said openings of said divider plate, each said retaining means including a first elongated tube for receiving a golf club, each said first tube having a spring associated therewith tending to bias the position of said tube, each said spring having a resilient restoration force when deformed, which is less than the combined weight of said tube and a golf club stored in it and is greater than the weight of said tube alone.

In accordance with the present invention there is further provided a golf club protector device for use in a golf bag having an opening therein, said device comprising; an elongated tube adapted to be positioned in said golf bag to receive a golf club shaft for storing said golf club, a resilient spring means having one end thereof operatively associated with said tube, said spring means being adapted to bias said tube into a position in which a portion of said tube is outside of said opening of said golf bag, said spring means having a resilient restoration force when substantially deformed which is less than the combined weight of said tube and said golf club and is greater than the weight of said tube.

In accordance with the present invention there is further provided a golf club protector device for use in a golf bag having an opening thereon, said device comprising; an elongated tube adapted to be positioned within a said golf bag for receiving and storing a golf club, a resilient spring means having a first end operatively associated with said tube and a second end adapted to be held immobile relative to said golf bag, said spring means being adapted to bias said tube into a position in which a portion of said tube is outside of said opening of said golf bag, means to limit movement of said tube away from said opening to a distance that will permit said tube to be readily visible beyond tops of other tubes in said bag, said spring means having a resilient restoration force when substantially deformed which is less than the combined weight of said tube and said golf club and is greater than the weight of said tube.

Figure 3:
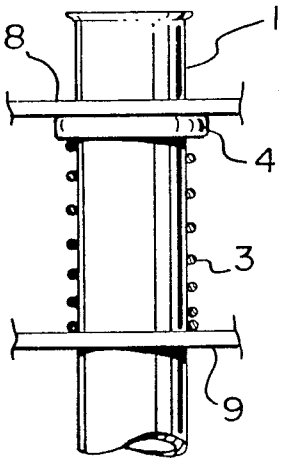
FIG. 3 illustrates a portion of a second embodiment of the invention with the club protective tube in its elevated position.

FIG. 4 illustrates a portion of the embodiment of the invention shown in FIG. 3, with the club protective tube in its depressed position.

DETAILED DESCRIPTION OF INVENTION

Figure 2:
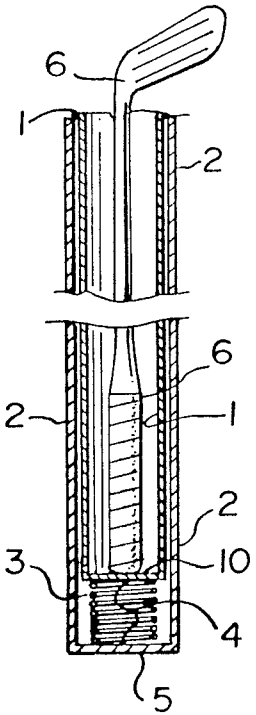
FIG. 2 illustrates a cross-section of the embodiment of FIG. 1 with a golf club positioned therein, wherein the club protective tube is in its depressed position.
Figure 1:
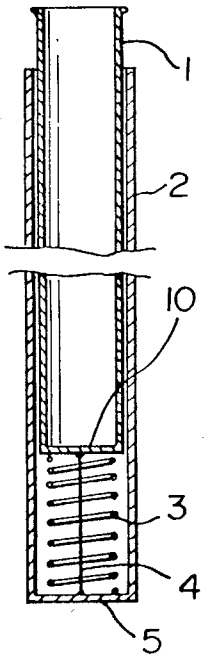
FIG. 1 illustrates a cross-section of an embodiment of the invention with the club protective tube in its elevated position.

In the embodiment of the invention shown in FIGS. 1 and 2 a club protective tube 1 having a length sufficient to accommodate a golf club shaft, is mounted inside a second tube 2 having an inner diameter slightly greater than the outer diameter of the tube 1, in order to permit the tube 1 to slide smoothly and easily inside tube 2. Tube 1 has a bottom wall 10 and tube 2 has a bottom wall 5. A compression spring 3 bears against the outside of bottom wall 10 of tube 1 and against the inside of bottom wall 5 of tube 2. A cord 4 joins tube 1 and tube 2 and limits the extent of movement of tube 1 relative to tube 2.

It has been found that a suitable inner tube 1 consists of a plastic tube having an inside diameter of 1.270 inches and an outside diameter of 1.360 inches and a length of 34 inches. An outer tube 2 which has been found to be suitable for use with the aforesaid inner tube consists of a plastic tube having an inside diameter of 1.504 inches and an outside diameter of 1.630 inches and a length of 35.5 inches. It will be appreciated that the tubes may be of various lengths. However the length of the outer tube is such that when the inner tube is resting in it at its proper height within the bag (level with the edge of the golf bag), the lip of the inner tube only will extend above the upper edge of the outer tube, as shown in FIG. 2 of the drawings. With these tubes a cord composed Nylon TM monofilament and having a length of 8 inches has been found to be suitable. A spring that has been found to be suitable for use in the invention is manufactured by Loyalty Metal Factory Ltd. of Calgary, Alberta, and comprises a compression spring having a diameter of 1.23 inches, a length of 8 inches without compression and a length of 0.7 inches when compressed. The spring has a resilient restoration force of 350 grams down to 2 inches and is composed of wire having a diameter of 0.039 inches.

In operation protective tube devices as illustrated in FIGS. 1 and 2 may be positioned in the circular openings of a divider plate (not illustrated) in a golf bag.

The outer tube 2 is held immobile relative to the divider plate and golf bag. The resilient restoration force of the spring 3 is such that the combined weight of a golf club 6 and the protective tube 1 will cause the spring to be compressed thereby allowing the protective tube 1 to sink to its depressed level, as shown in FIG. 2, when a golf club 6 is positioned therein. When the club 6 is removed from the protective tube 1, the spring resilient restoration force being greater than the weight of the empty tube will cause the tube 1 to move upwardly to its elevated position as shown in FIG. 1. The cord 4 connecting the tube 1 and tube 2 will limit the distance of upward travel of the tube 1 relative to tube 2. At its point of maximum movement, the upper end of tube 1 will extend beyond the level of the tops of other tubes in the golf bag thus providing a visible and unobscured tube opening within which to replace the golf club 6.

The above described protective devices may also be used in a golf bag without a divider with the bottom 5 thereof resting on the bottom of the golf bag.

FIGS. 3 and 4 show an alternative embodiment wherein no outer tube is employed and the spring 3 is situated along the length of the tube 1.

In the embodiment of FIGS. 3 and 4 the protective tube 1 is inserted in aligned circular openings in divider plates 8 and 9 in a golf bag (not illustrated). The protective tube 1 has an outside diameter which is slightly less than the diameter of the circular openings in the divider plates to permit sliding movement of the tube 1 relative to the divider plates 8 and 9. A compression spring 3 bears against lower divider plate 9 and against stop ring 4 on the tube 1. In the elevated position of tube 1 illustrated in FIG. 3, the stop ring 4 bears against upper divider plate 8 thereby limiting the distance of upward movement of the tube 1.

When a golf club 6 is positioned in the protective tube 1, the weight of the club in combination with the weight of the tube 1 causes spring 3 to be compressed until the tube 1 sinks to its depressed level as shown in FIG. 4.

As with the embodiment of FIGS. 1 and 2, the spring 3 has a resilient restoration force which is greater than the weight of the tube 1 empty but is less than the combined weight of the tube 11 and golf club 6, with the result that the upper portion of the tube 1 will rise above the level of the tops of the other tubes in the golf bag, when the golf club 6 is removed from the tube 1.

It will be appreciated that in place of a compression spring 3 the device illustrated in FIGS. 3 and 4 may employ a tension spring having one end attached to the upper divider plate 8 and the other end attached to the tube 1 with the stop ring 4 positioned at the lower end of the spring to limit the downward movement of the tube 1. Such compression spring would have a resilient restoration force which is greater than the weight of the tube 1 when empty and less than the combined weight of the tube 1 and golf club 6.

What I claim as my invention is:

1. A protective device for storing a golf club comprising:

an elongated tube within which said golf club is adapted to be stored, resilient spring means operatively associated with said tube for biasing the position of said tube, said spring means having a resilient restoration force when deformed which is less than the combined weight of said tube and said golf club and is greater than the weight of said tube.

2. A protective device in accordance with claim 1 wherein said spring means includes a first end thereof operatively associated with said tube, said spring means being adapted to be resiliently deformed under the combined weight of said tube and said club when said club is stored in said tube, whereby when said club is removed from storage in said tube said restoration force of said spring produces upward movement of said tube.

3. A protective device in accordance with claim 1 wherein said spring means includes a second end thereof operatively associated with a golf club transportation means, said tube being adapted to be oriented such that when said club is stored in said tube the combined weight of the club and tube will cause said tube to move downwardly and will cause said spring means to be resiliently deformed.

4. A protective device in accordance with claim 3 wherein said restoration force of said spring means causes said tube to move upwardly when said golf club is removed from said tube.

5. A protective device for a golf club comprising:

a first elongated tube within which said golf club is adapted to be stored, a second elongated tube having an inner diameter greater than the outer diameter of said first tube, said first tube being positioned within said second tube in slidable relationship thereto, resilient spring means having first and second ends, said first end of said spring means being operatively associated with said first tube and said second end of said spring means being operatively associated with said second tube, said spring means being adapted to bias said first tube to a position wherein a portion of said first tube is outside said second tube.

6. A protective device in accordance with claim 5 wherein said spring means has a resilient restoration force which is less than the combined weight of said first tube and said golf club and is greater than the weight of said first tube alone.

7. A protective device in accordance with claim 6 wherein the inner diameter of said first tube is such as to enable it to receive therein the shaft of said golf club and the outer diameter of said second tube is such as to enable it to be mounted in openings of a separator plate in a golf bag.

8. A protective device in accordance with claim 6 including means to limit the extent of outward movement of said first tube relative to said second tube.

9. A protective device in accordance with claim 5, 6 or 7 including a cord having a first end attached to said first tube and a second end attached to said second tube to thereby limit the movement of said first tube relative to said second tube.

10. A protective device in accordance with claim 6 wherein a first end of said second tube is closed by a plug means, said spring means comprises a compression spring, said second end of which bears against said plug means and said first end thereof bears against said first tube, thereby biasing said first tube away from said first end of said second tube.

11. A protective device in accordance with claim 5, 6 or 8 wherein said spring means comprises a tension spring having said first end thereof attached to said first tube and said second end thereof attached to said second tube, said spring serving to bias said first tube to a position wherein said first tube is outside said second tube to a maximum extent and means to limit said outward movement of said first tube.

12. A protective device in accordance with claim 2 including means to limit movement of said tube as a result of said resilient restoration force of said spring means.

13. Protective apparatus for storing golf clubs in a golf bag, comprising:

a divider plate having a plurality of circular openings, a plurality of golf club retaining means within said openings of said divider plate, each said retaining means including a first elongated tube for receiving a golf club, each said first tube having a spring associated therewith tending to bias the position of said tube, each said spring having a resilient restoration force when deformed, which is less than the combined weight of said tube and a golf club stored in it and is greater than the weight of said tube alone.

14. Protective apparatus in accordance with claim 13, each said retaining means including a second tube within which said first tube is slidably positioned, each said spring means having a first end operatively associated with said first tube and a second end operatively associated with said second tube, means to limit the extent of relative movement of said first and second tubes, each said tube being immobile relative to said divider plate, each said spring tending to bias said first tube to a position wherein said first tube is outside the second tube to a maximum extent permitted by said movement limiting means.

15. A protective device in accordance with claim 10 wherein a first end of said second tube is closed by a plug means, said spring means comprises a compression spring, said second end of which bears against said plug means and said first end thereof bears against said first tube, thereby biasing said first tube away from said first end of said second tube.

16. A protective device in accordance with claim 10 wherein said spring means comprises a tension spring having said first end thereof attached to said first tube and said second end thereof attached to said second tube, said spring serving to bias said first tube to a position wherein said first tube is outside said second tube to a maximum extent.

17. A golf club protector device for use in a golf bag having an opening therein, said device comprising;

an elongated tube adapted to be positioned in said golf bag to receive a golf club shaft for storing said golf club, a resilient spring means having one end thereof operatively associated with said tube, said spring means being adapted to bias said tube into a position in which a portion of said tube is outside of said opening of said golf bag, said spring means having a resilient restoration force when substantially deformed which is less than the combined weight of said tube and said golf club and is greater than the weight of said tube.

18. A golf club protector device for use in a golf bag having an opening thereon, said device comprising;

an elongated tube adapted to be positioned within a said golf bag for receiving and storing a golf club, a resilient spring means having a first end operatively associated with said tube and a second end adapted to be held immobile relative to said golf bag, said spring means being adapted to bias said tube into a position in which a portion of said tube is outside of said opening of said golf bag, means to limit movement of said tube away from said opening to a distance that will permit said tube to be readily visible beyond the tops of other tubes in said bag, said spring means having a resilient restoration force when substantially deformed which is less than the combined weight of said tube and said golf club and is greater than the weight of said tube.

* * * * *